US005271508A

United States Patent [19]

Gamwell

[11] Patent Number: 5,271,508

[45] Date of Patent: Dec. 21, 1993

[54] SERVING DISH FOR STEMMED GRAPES

[76] Inventor: Gordon K. Gamwell, 10046 Hanka, Houston, Tex. 77080

[21] Appl. No.: 885,040

[22] Filed: May 15, 1992

[51] Int. Cl.[5] ..... B07B 1/00

[52] U.S. Cl. ..... 209/682; 209/374; 220/574; 220/502

[58] Field of Search ..... 209/680, 682, 659, 374; 220/574, 23.83-23.86, 501, 502

[56] References Cited

U.S. PATENT DOCUMENTS

| | | | |
|---|---|---|---|
| D. 31,737 | 10/1899 | Bardwell | D7/557 |
| D. 195,072 | 4/1963 | Kolarik | D7/501 |
| 1,141,727 | 6/1915 | Seaman | 209/680 |
| 1,278,597 | 9/1918 | Comley | 220/502 |
| 1,373,297 | 3/1921 | Brown | 209/374 |
| 1,829,844 | 11/1931 | Altmayer | 220/501 |
| 1,955,919 | 4/1934 | Kress | 220/23.83 |
| 2,040,004 | 5/1936 | Kelsay | 209/374 |
| 3,009,599 | 11/1961 | Schier | 220/574 |
| 3,028,038 | 4/1962 | Wyngarden | 220/23.83 |
| 3,139,209 | 6/1964 | Wire | 220/23.83 |
| 3,756,462 | 9/1973 | Cain | 220/23.83 |
| 3,847,575 | 11/1974 | Harding | 220/501 |

*Primary Examiner*—H. Grant Skaggs

[57] ABSTRACT

In the representative embodiment of the fruit server of the invention, a display container is arranged to support one or more bunches of grapes. Openings are arranged adjacent to a sloping wall portion of the container and respectively sized so that should individual grapes become detached from the clustered grapes supported by the container, those detached grapes will work themselves along the sloping bottom and fall through the openings and be collected on a lower collector container spatially disposed below the upper display container.

8 Claims, 2 Drawing Sheets

SERVING DISH FOR STEMMED GRAPES

BACKGROUND OF THE INVENTION

It is a common experience for one or more grapes to become detached from a cluster or bunch of edible grapes on a serving plate or bowl as other grapes are successively removed from that bunch and eaten. The periodic detachment of individual grapes from a bunch is, of course, of little or no consequence so long as these detached grapes are discovered within a reasonable time. Unfortunately, however, unless most of the grapes in a particular bunch are consumed within a reasonably short time, some of the grapes which are unknowingly detached from a large bunch will be concealed underneath other grapes in the bunch. Since the grapes most likely to become detached are usually the ripest grapes in a particular cluster, those detached grapes which remain undetected for even a brief period will become discolored; and, if they are damp, those detached grapes will often become partially rotted before they are discovered. Other grapes which are touching the detached grapes may also be affected.

OBJECTS OF THE INVENTION

Accordingly, it is an object of the invention to provide new and improved apparatus for serving clusters of grapes in an attractive manner and which is operative for segregating individual grapes that become detached from a cluster on the server.

It is a further object of the invention to provide servers having a primary portion specially arranged to display clustered grapes that are joined together by stems as well as a secondary portion specially arranged for separately displaying individual grapes which have unknowingly been separated from their principal cluster.

It is a further object of the invention to provide servers for bunches of grapes that are initially joined together and may at least partially rot unless individual grapes in the bunch that become unknowingly detached from the bunch are timely removed from the server.

SUMMARY OF THE INVENTION

These and other objects of the invention are attained by a new and improved server for initially-attached grapes which is provided with a fruit-serving receptacle or dish cooperatively arranged for displaying one or more bunches of grapes. At least one escape opening is arranged in the serving receptacle so that as individual grapes become detached from a cluster of grapes on the serving receptacle, the detached grapes will pass through the opening and received in a collecting receptacle spatially disposed from the serving receptacle.

BRIEF DESCRIPTION OF THE DRAWINGS

The novel features of the present invention are set forth with particularity in the appended claims. The invention along with still other objects and additional advantages thereof may be best understood by way of exemplary apparatus which employs the principles of the invention as best depicted in the accompanying drawings in which:

DESCRIPTION OF A PREFERRED EMBODIMENT OF THE INVENTION

Figure 1:
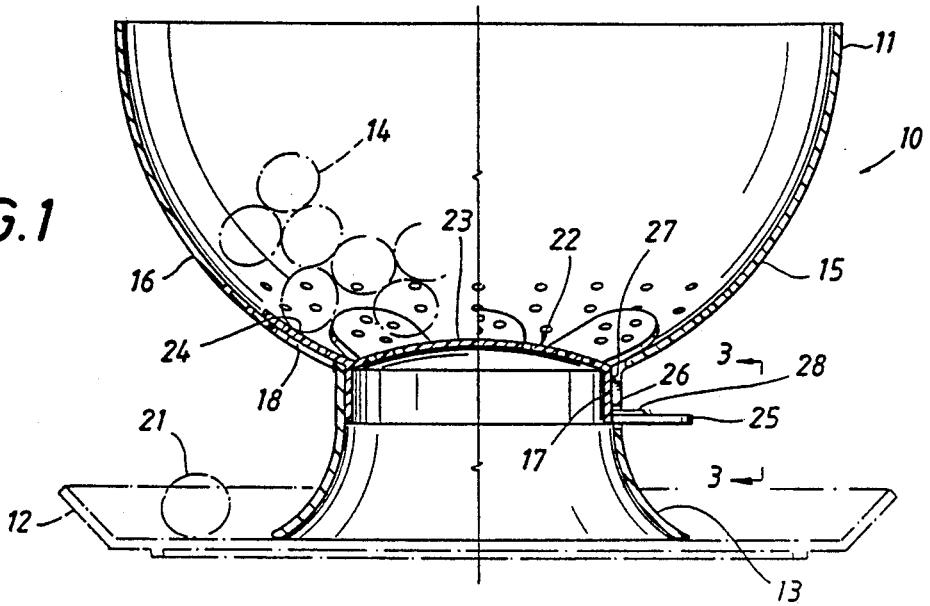
FIG. 1 is an isometric view showing a preferred embodiment of a grape server arranged in accordance with the principles of the invention.

Turning now to FIG. 1, an isometric view is shown of a preferred embodiment of a new and improved grape server 10 which is cooperatively arranged in accordance with the principles of the present invention. As illustrated, the new and improved grape server 10 includes a serving receptacle or upper container 11 that is positioned in a stacked relationship immediately above a fruit collector or lower container 12 by support means such as an upright base or central pedestal as indicated generally at 13.

The upper serving container 11 can be of any appropriate configuration and size for containing a typical cluster or bunch of grapes such as those shown generally at 14. Nevertheless, as depicted in FIG. 1, in the preferred embodiment of the new and improved grape server 10, the serving container 11 is preferably configured as an upwardly-facing concave bowl having upstanding sides 15 flaring outwardly from a moderately-rounded central downwardly-sloping base portion 16. The height of the sides 15 (i.e., the depth of the concave bowl 11) as well as the internal diameter of the bowl will, of course, govern the size of the bunch of grapes, as at 14, that may be conveniently contained in the upper bowl at any particular time. In a similar fashion, although the server 10 may comprise a special collector, the collector 12 is preferably arranged as a typical plate including a central relatively-flat portion on which the upright pedestal 13 may be conveniently set as well as having a sufficient outer diameter which is more or less equal to the outer diameter of the upper serving container 11. It will be appreciated that the lower plate 12 may also be a separate element if desired.

Figure 2:
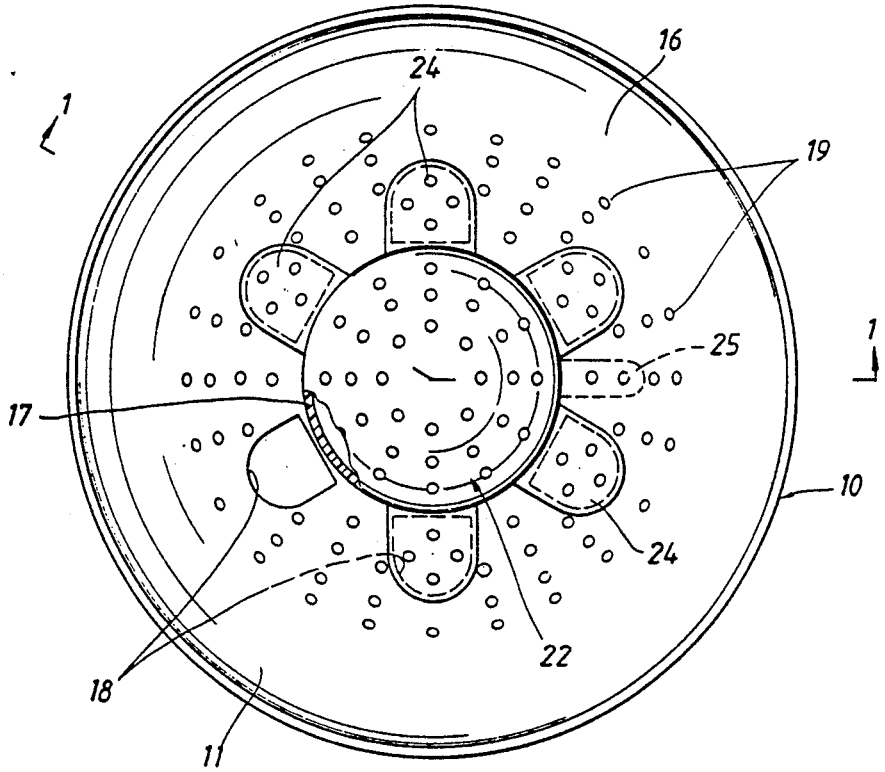
FIG. 2 is a plan view of the grape server illustrated in FIG. 1.

As illustrated in FIG. 2, the upper collector 11 further includes a single circular hole or central opening 17 which is preferably arranged in the central base portion or bottom 16 of the serving container 11 to be coaxially disposed in relation to the upstanding central support 13. As generally indicated at 18, a group of circular openings are cooperatively arranged in the central bottom portion 16 of the serving bowl 11 and, in the depicted preferred embodiment, coaxially distributed in a uniform pattern around the central opening 17. The smaller openings 18 are appropriately sized for readily accommodating the passage of a single loose grape which has moved downwardly into the center portion 16 of the serving container 11. It should be appreciated that as an alternative to the respective circular openings 18, one or more escape openings such as elliptical holes or elongated slots (not illustrated in the drawings) could also be distributed at various locations around the central opening 17 in the serving container 11. In addition to the larger escape openings 18, a series of smaller holes, as at 19, are provided around the lower portions of the upstanding side walls 15 of the new and improved serving container 11 for facilitating the draining of water used to rinse off or wash the several grapes in the depicted bunch as at 14.

In the utilization of the new and improved server 10 of the present invention, it will be appreciated that once a bunch of grapes, as at 14, has been placed in the upper serving bowl 11, the bunch will be conveniently positioned for the removal of one or more grapes. As is typical, as these grapes are removed from the main bunch 14, the periodic movements of the clustered grapes will, from time to time, cause one or more single grapes, as at 21, to become detached. As discussed above, those grapes, as at 21, which are detached from the main cluster of grapes 14 can be easily trapped below the clustered grapes and quickly rot unless the loose grapes are removed. Accordingly, in keeping with the principles of the invention, as depicted in FIG. 1, whenever a grape, as at 21, becomes detached from the main cluster of grapes 14, it will be free to work downwardly toward the central opening 17 in the center of the rounded bottom portion 16 of the serving bowl 11.

It will be recognized, of course, that unless a loose grape, such as at represented at 21, happens to pass over one of the openings 18 before it reaches the central bottom portion 16 of the serving bowl 11, the loose grape will fall through the central opening 17. Thus, to cover the opening 17 as well as promote the movement of loose grapes, as at 21, through the openings 18, a plug is rotatably installed in the central opening. As best seen in FIG. 1, the loose plug 22 includes a domed central portion 23 having an outer diameter that is somewhat smaller than a circle (not illustrated) tangentially circumscribing the inward edges of the several holes 18. To facilitate selective blocking of the escape openings 18, a corresponding number of outwardly-projecting vanes, as at 24, are uniformly disposed around the central domed portion 23 of the rotatable plug 22 and cooperatively sized for simultaneously uncovering the escape openings whenever the plug is turned from its angular blocking position depicted in FIG. 2 to an angular position (not illustrated in the drawings) for locating the vanes between the spatially-disposed escape openings. Although the rotatable plug 22 can be conveniently turned by reaching through the clustered grapes 14 to gain access to the lower portion of the serving bowl 11, it is instead preferred to provide a lateral handle 25 on one side of the rotatable plug 22 and extend this handle outwardly through a transverse slot 26 on one side of the central pedestal 13. To facilitate the assembly of the new and improved server 10, a short vertical slot 27 may be arranged in the central pedestal 13 to extend upwardly a short distance above the midpoint of the transverse slot 26 so that the handle 25 may be quickly installed into its depicted operating position.

Figure 3:
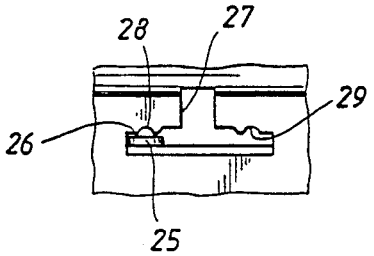
FIG. 3 is a detail drawing of one element of the server shown in FIGS. 1 and 2.

The angular position of the rotatable plug 22 will, of course, usually remain constant whenever the plug has been located in any particular angular position. Nevertheless, as best seen in FIG. 3, to positively retain the rotatable plug 22 in a particular angular position, it is preferred to include an upstanding ridge 28 on the upper surface of the handle 25 which is cooperatively sized and situated so that when the handle is turned, the upward bias of the resilient handle will be effective for selectively disposing the outstanding ridge within one or the other of the two downwardly-facing complementary notches 29 on opposite ends of the transverse slot 26. The detent mechanism cooperatively provided by the ridge 28 and notches 29 will, of course, allow the server 10 to be moved about without allowing the rotatable plug 22 to be inadvertently turned to a position where the vanes 16 are not completely covering the openings 18.

It will, of course, be understood that when the rotatable plug 22 has been positioned where the vanes 24 are respectively covering the escape openings 18, the server 10 can be readily moved around without concern that one or more loose grapes, as at 21, may fall out of the serving bowl 11. It will be appreciated as well that since the paramount function of the container or plate 12 is to collect loose grapes, as at 21, and make them visible while they are still tasty, those loose grapes can be readily consumed in advance to the other grapes that are still attached to the main bunch 14.

In the preferred construction of the server 10, the serving container 11 as well as the rotatable plug 22 are fabricated as individual interfitting pieces which are appropriately shaped and sized to facilitate their individual manufacture as well as their fool-proof installation and removal whenever the new and improved server 10 is assembled and disassembled. It must be understood, however, that neither the particular configuration of the serving bowl 11 nor the respective positions and relative sizes of the vanes depicted in the drawings are critical to the practice of the invention so long as there is at least one escape opening, as at 18, in a lower portion of the serving bowl that is positioned above at least a portion of the plate 12.

It is, of course, desirable that the serving container 11 has an aesthetically-pleasing shape which may be readily formed from suitable materials such as metal, wood and moldable plastics appropriately selected to provide an attractive server 10 which can be easily disassembled for cleaning or storage. To this end, it is preferred that the new and improved fruit server 10 of the invention be formed from a suitable thermal-setting plastic which can be economically molded in large quantities and finished to provide an attractive serving device of moderate cost.

Figure 4:
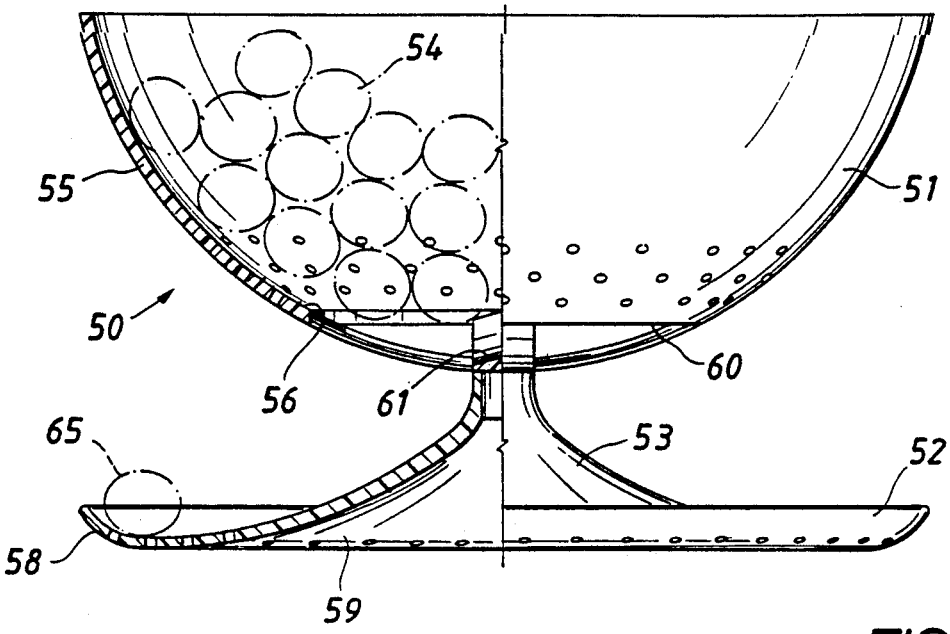
FIG. 4 is an isometric view which is functionally similar to FIG. 1 but shows an alternative embodiment of a grape server in keeping with the objects of the invention.
Figure 5:
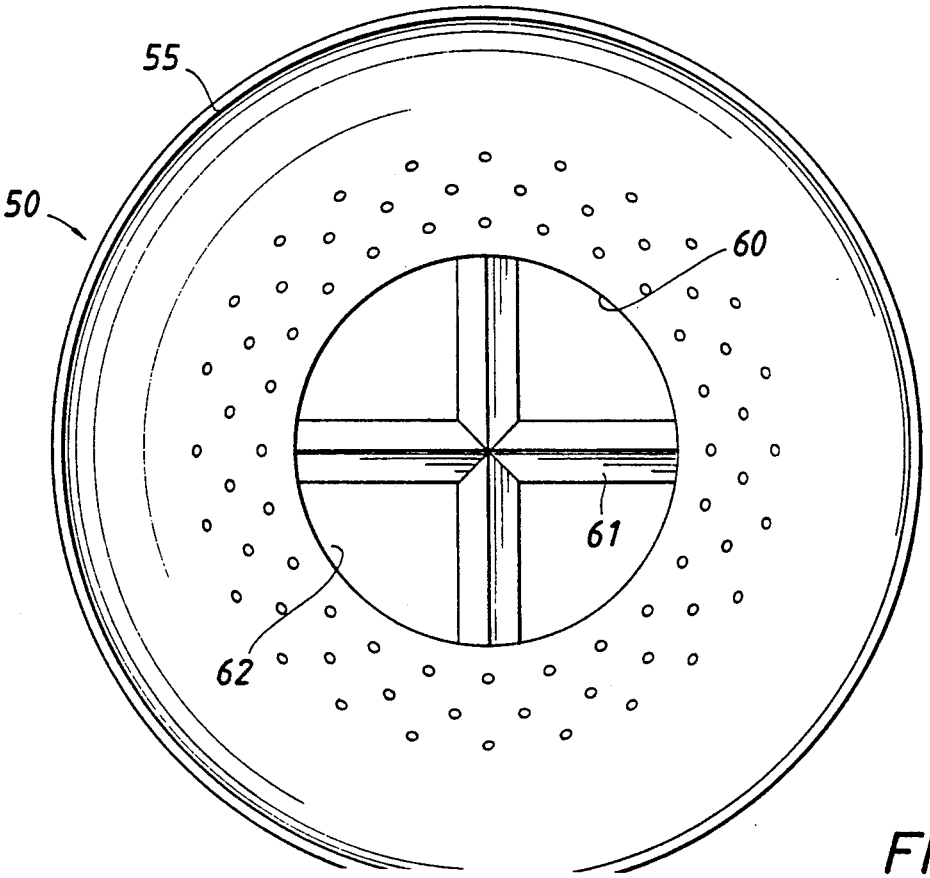
FIG. 5 is a plan view of the server depicted in FIG. 4.

Turning now to FIG. 4, an isometric view is shown of an alternative embodiment of another grape server 50 cooperatively arranged in accordance with the principles of the invention. As shown, the server 50 includes an upper serving receptacle or container 51 that is positioned in a stacked relationship above a lower fruit collector or container 52 by support means such as an upright central stem as indicated generally at 53.

It will, of course, be appreciated that the upper container 51 can be any appropriate configuration and size selected for conveniently supporting a typical cluster or bunch of grapes such as those shown generally at 54. Nevertheless, as depicted, in the preferred embodiment of the new and improved grape server 50, the serving container 51 is preferably configured as an upwardly-facing concave bowl having upstanding sides 55 which are flared outwardly from a moderately-rounded central bottom or downwardly-sloping base portion 56. The height of the sides 55 (i.e., the depth of the concave bowl 51) as well as the internal diameter of the bowl will, of course, govern the size of the bunch of grapes, as at 54, which may be conveniently contained in the upper bowl at any particular time. In a similar fashion, the collector 52 is preferably arranged as an upwardly-facing annular receptacle with outwardly-diverging outer walls 58 and having a sufficient diameter to provide a stable base 59 for maintaining the new and improved grape server 50 of the present invention in its normal upright position. As illustrated, the central portion of the collector bowl 52 is preferably configured to provide upwardly-converging inner walls that gradually taper in an attractive fashion to provide the central upright support 53 for the serving bowl 11.

In keeping with the principles of the present invention, as best seen in FIG. 3, another embodiment of the new and improved grape server 50 further includes a single circular hole or opening 60 which is cooperatively arranged in the bottom or depressed central portion 56 of the serving container 51 to be coaxially disposed in relation to the upstanding central support 53. An X-shaped transverse cross member 61 is provided for coaxially mounting the central portion of the fruit container 51 on the upper end of the upright support 53. It should be noted that each of the sectorial openings, as indicated at 62, defined within the opening 60 by the cross member 61 are appropriately sized for readily accommodating the passage of an individual piece of fruit such as a single grape which has moved toward the center of the serving container 51. It should be appreciated that as an alternative to the circular opening 60 in the center of the upper container 51, one or more escape openings such as oval holes or elongated slots (not illustrated in the drawings) could also be distributed at various locations around the central portion of the upper container as might be considered advantageous for providing multiple escape ports for individual detached grapes which might possibly be trapped at such locations on the bottom of the upper container.

In the utilization of the new and improved server 50 of the present invention, it will be appreciated that once a bunch of grapes, as at 54, has been placed in the upper serving bowl 51, the bunch will be conveniently positioned for the removal of one or more grapes. As is typical, as these grapes are removed from the main bunch 54, the periodic movements of the clustered grapes will, from time to time, cause one or more single grapes, as at 65, to become detached. As discussed above, those grapes, as at 25, which are detached from the main cluster of grapes 54 can be easily trapped below the clustered grapes and quickly rot unless the loose grapes are removed. Accordingly, in keeping with the principles of the invention, as depicted in FIG. 3, whenever a grape, as at 65, becomes detached from the main cluster of grapes 54, it will be free to work downwardly toward the central opening 60 in the center of the rounded bottom portion 56 of the serving bowl 51. Once a loose grape, such as at 65, reaches the central bottom portion 56 of the serving bowl 51, the loose grape will readily pass through the central opening 60 and be collected in an exposed or visible position in the concave annular portion of the lower bowl 52. It will, of course, be appreciated that even though the primary function of the container 52 is for simply collecting loose grapes, as at 65, and making them visible, those loose grapes can still be readily consumed.

In the preferred construction of the server 50, the upper and lower containers 51 and 52 as well as the transverse cross member 61 are fabricated as individual interfitting pieces which are appropriately shaped and sized to facilitate their individual manufacture as well as their fool-proof installation and removal whenever the new and improved server 60 is being assembled and disassembled. It must be understood, however, that neither the particular configurations of the serving bowls 51 and 52 nor the respective positions and relative sizes of the upper and lower fruit containers depicted in the drawings are critical to the practice of the invention so long as there is an escape opening, as at 62, in a lower portion of the upper serving bowl that is positioned above at least a portion of the lower serving bowl.

It is, of course, desirable that the containers 51 and 52 as well as the upright central stem 53 have aesthetically-pleasing shapes which may be readily formed from suitable materials such as metal, wood and moldable plastics appropriately selected to provide an attractive server 50 which can be easily disassembled for cleaning or storage. To this end, it is preferred that the new and improved fruit server 50 of the present invention be formed from a suitable thermal-setting plastic which can be economically molded in large quantities and finished to provide an attractive serving device of moderate cost.

While only particular embodiments of the present invention have been described above and illustrated in the drawings, it is readily apparent that various changes and modifications may be made without departing from the invention in its broader aspects; and, therefore, the aim in the claims which are appended hereto is to cover those changes and modifications which fall within the true spirit and scope of the present invention.

What is claimed is:

1. A server for one or more clusters of grapes comprising:

a generally-concave display receptacle for receiving at least one cluster of attached grapes and including a bottom wall bounded by downwardly-sloping side walls;

means arranged for facilitating the escape from said display receptacle of individual grapes which have been detached from a cluster of grapes disposed in said display receptacle and moved downwardly along said sloping side walls into the lower portion of said display receptacle and including escape passage means in said lower portion and larger than the anticipated size of individual grapes to be disposed in said display receptacle;

a support for normally positioning said display receptacle above a collector receptacle for receiving detached grapes which have moved downwardly along said sloping side walls and passed through said escape passage means; and means for selectively obstructing said escape passage means in said display receptacle.

2. The grape server of claim 1 wherein said escape passage means include a central escape opening in said bottom wall of said display receptacle.

3. The grape server of claim 1 wherein said escape passage means include a plurality of escape openings spatially disposed around said downwardly-sloping side walls above said bottom wall of said display receptacle.

4. The grape server of claim 1 further including at least a single drain opening in said display receptacle for draining water out of said display receptacle.

5. A server for clusters of grapes comprising:

an upwardly-opening dished primary container for displaying clusters of grapes and having downwardly-sloping side walls surrounding a lower portion with a central escape opening for passing detached grapes that have moved downwardly along said sloping side walls into said lower portion of said primary container from underneath clusters of grapes in said primary container;

a secondary container for placement on a supporting base and for receiving detached grapes falling through said central escape opening;

a support member spatially disposing said primary container above said secondary container at a sufficient height to accommodate detached grapes moving along said sloping side walls and falling through said central escape opening onto said secondary container; and means arranged within said lower portion of said primary container for selectively blocking said central escape opening.

6. A server for clusters of grapes comprising:

an upwardly-opening dished primary container for displaying clusters of grapes and having a lower portion with a plurality of escape openings arranged therearound for passing detached grapes that have moved downwardly into said lower portion of said primary container from underneath clusters of grapes displayed therein;

a secondary container for placement on a supporting base and for receiving detached grapes passing through said escape openings;

a support member spatially disposing said primary container above said secondary container at a height which is sufficient to accommodate detached grapes falling through said escape openings onto said secondary container; and means arranged within said lower portion of said primary container for selectively blocking said escape openings.

7. The grape server of claim 6 wherein said escape openings include a central escape opening in said lower portion of said primary container.

8. The grape server of claim 6 wherein said escape openings include a central escape opening in said lower portion of said primary container and a plurality of escape openings spatially disposed around said lower portion of said primary container above said central escape opening.

* * * * *